US007412961B2

(12) United States Patent
Doring

(10) Patent No.: US 7,412,961 B2
(45) Date of Patent: Aug. 19, 2008

(54) INTAKE DEVICE

(75) Inventor: Manfred Doring, Hamburg (DE)

(73) Assignee: Dolmar GmbH, Hamburg (DE)

( * ) Notice: Subject to any disclaimer, the term of this patent is extended or adjusted under 35 U.S.C. 154(b) by 0 days.

(21) Appl. No.: 11/608,280

(22) Filed: Dec. 8, 2006

(65) Prior Publication Data

US 2007/0131195 A1 Jun. 14, 2007

(30) Foreign Application Priority Data

Dec. 9, 2005 (DE) ..... 20 2005 019 420 U

(51) Int. Cl.
*F02M 35/02* (2006.01)
*F01P 1/02* (2006.01)
*B27B 17/00* (2006.01)

(52) U.S. Cl. ..... 123/198 E; 123/41.7; 30/381

(58) Field of Classification Search ..... 123/198 E, 123/41.65, 41.7; 55/337, 394
See application file for complete search history.

(56) References Cited

U.S. PATENT DOCUMENTS 4,276,067 A * 6/1981 Lindman ..... 55/337
5,746,160 A 5/1998 Stark et al.
6,681,726 B2 * 1/2004 Linsbauer et al. ..... 123/41.65

FOREIGN PATENT DOCUMENTS

| | | |
|---|---|---|
| DE | 25 50 165 | 5/1976 |
| DE | 92 11 498.9 | 12/1992 |
| DE | 44 01 186 | 7/1994 |
| DE | 101 28 790 | 12/2002 |
| GB | 2 279 995 | 1/1995 |

* cited by examiner

*Primary Examiner*—Stephen K. Cronin
*Assistant Examiner*—Hyder Ali
(74) *Attorney, Agent, or Firm*—McCormick, Paulding & Huber LLP

(57) ABSTRACT

To improve an intake device (100) for a handheld tool implemented having an air cleaner, particularly for a chainsaw, a cuffing-off grinder, or the like, which comprises an internal combustion engine (25) and a drive unit (20) for the attachment, the air cleaner cleaning combustion air, which is charged with dirt particles, for the engine (25), in that a centrifugal separator (30) separates the combustion air into at least one first air flow (31), which is freed from dirt particles as much as possible, and a second air flow (32), which is loaded with dirt particles, in particular to cause higher efficiency of the intake device, it is suggested that a blower (10) be situated on the drive unit (20), which sucks in the second air flow (32), by which cooling of the drive unit (20) is caused.

13 Claims, 4 Drawing Sheets

INTAKE DEVICE

CROSS-REFERENCE TO RELATED APPLICATIONS

This application is entitled to the benefit of German Patent Application No. 20 2005 019 420.4 filed on Dec. 9, 2005.

FIELD OF THE INVENTION

The present invention relates to an intake device for a handheld tool implemented having an air cleaner, in particular for a chainsaw, a cutting-off grinder, or the like, which comprises an internal combustion engine and a drive unit for the attachment, the air cleaner purifying combustion air for the engine which is charged with dirt particles in that a centrifugal separator separates the combustion air into at least one first air flow, which is freed from dirt particles as much as possible, and a second air flow, which is loaded with dirt particles.

BACKGROUND OF THE INVENTION

It is known from the prior art that when handheld tools operated using internal combustion engines are used, such as cutting-off grinders, chainsaws, or the like, the air sucked in by the engine entrains dirt particles, extremely fine dust, or other solids, which results in significant wear of the engine, for example, at the piston and cylinder, or in frequent maintenance intervals of the intake air filter. Oil-impregnated foam filters are used for air filters of this type, for example. These filters do largely prevent dirt particles from reaching the engine, but a strongly contaminated filter also causes the quantity of combustion air to be reduced and thus the output of the engine to decrease. The maintenance intervals which are thus frequently necessary are time-consuming and costly, in addition, these intervals are no longer performed if the frequency is too high, so that the above-mentioned output reduction remains in existence or is even amplified.

SUMMARY OF THE INVENTION

To keep the combustion air as clean as possible and thus avoid the above-mentioned problems, manifold dust separators and/or intake systems for the combustion air have been suggested.

An intake device for a lawnmower, which has a cylindrical housing having tangential air intake openings, the combustion air being removed in the center of the housing, is described in DE-AS 25 50 165. The combustion air flowing in tangentially forms a vortex, so that the air is cleaned as in a cyclone dust separator, in that the solid particles (dirt particles) are carried outward because of the centrifugal force. In the center, the vortex thus contains relatively few dirt particles, so that the combustion air removed there is significantly cleaner than the normal intake air.

An intake device for the combustion air of an internal combustion engine for handheld tool is described in DE 101 28 790 A1. The intake device has a centrifugal separator, which divides the flow of the combustion air into a central core flow having lower particle density and a mantle flow, enclosing the core flow, having greater particle density than in the core flow, the core flow essentially being supplied by an air filter into the combustion chamber of the internal combustion engine and the mantle flow, which is loaded with the dirt particles, being removed.

It is the object of the present invention to improve an intake device according to the species for combustion air of internal combustion engines having an air cleaner, in particular to produce higher efficiency of the intake device.

For this purpose, according to the present invention, a blower is situated on the drive unit, which sucks in the second air flow, by which cooling of the drive unit is caused. In operation of the tool, the combustion air for the internal combustion engine is sucked in from the surroundings, the intake air being loaded by dirt particles, which arise as dust during the cutting-off grinding procedure with a cutting-off grinder. The centrifugal separator, which may be implemented as a cyclone, in particular as an axial cyclone or a turbo filter, preferably generates a central first air flow (core flow) in the interior having a low dirt particle density, i.e., an air flow as free from dirt particles as much as possible, preferably having the finest particles, and a second air flow (mantle flow) enclosing the first air flow (core flow). The second air flow (mantle flow) has a greater dirt particle density having particles of large and moderate diameter. The centrifugal separator is preferably implemented in such a way that it has an inlet cylinder, in which the combustion air sucked in from the surroundings is brought onto an essentially circular path by injection from the side, the rotational velocity of the flow thus formed increasing in the outer area in such a way that the dirt particles are centrifuged outward by the resulting centrifugal forces. The first air flow, which is extensively freed from dirt particles, leaves the centrifugal separator centrally and is conducted in the direction of the combustion chamber. The dirt-loaded second air flow is sucked in by the blower which is situated on the drive unit of the tool.

The first air flow, which is free of dirt particles, is supplied to the combustion chamber of the internal combustion engine, the second air flow, which is loaded by dirt particles, simultaneously being sucked in by the blower and simultaneously cooling the clutch of the tool. In contrast to the prior art, the second air flow is not blown out immediately into the surroundings, but rather is exploited as a coolant for the clutch, which may reach high temperatures during operation.

In an especially preferred embodiment of the present invention, the drive unit comprises a crankshaft, which is drivable by the engine, and a clutch, on which the blower is directly situated. The crankshaft, which is situated with the engine in an engine housing, drives the clutch and the blower at an appropriate speed. The clutch is expediently implemented as a centrifugal clutch, which is positioned in a clutch drum, the clutch drum being driven by the clutch at a corresponding speed of the crankshaft. A frictional connection between the clutch and the clutch drum may be produced by corresponding centrifugal weights, which are situated on the centrifugal clutch, at a corresponding speed of the engine. This means that the weights move outward in the event of increasing speed, by which contact is produced to the inner wall of the clutch drum, which is simultaneously used as a drive for the tool. The centrifugal clutch used in the present invention operates automatically in this case. The transmittable torque is a function of speed, the centrifugal clutch disconnecting automatically in the event of a speed drop.

According to the present invention, the centrifugal clutch is set by the weights in such a way that the engine is disengaged from the dutch drum in idle. If the speed is increased, the centrifugal dutch engages and the engine provides torque for the clutch drum, which drives the attachment. If there is blocking on the driven attachment side, the clutch slips, i.e., there is a friction lock between the clutch drum and the centrifugal clutch. The energy is thus converted into heat and the user of the tool is protected from injuries.

In a further possible embodiment of the present invention, the blower comprises a ventilator wheel which is received in a blower housing and is situated so it is rotatably mounted around an axle. The ventilator wheel, which comprises a metallic material in one possible embodiment, for example, is used to convey dust which occurs in the surroundings during operation of the tool. The ventilator wheel generates a corresponding partial vacuum which sucks in intake air charged with dirt particles into the blower. After the centrifugal separator has separated the intake air from the dirt particles as much as possible, the air flow loaded with dirt particles reaches the blower housing of the ventilator wheel and simultaneously causes cooling of the centrifugal clutch situated directly on the ventilator wheel. The ventilator wheel preferably has a corresponding heat transmission coefficient, which ensures good heat transmission from the centrifugal clutch to the ventilator wheel.

In a further alternative of the present invention, it may be advisable for the clutch and the ventilator wheel to be in one piece and/or to be materially bonded to one another. For example, it is conceivable for the ventilator wheel to be sprayed onto the centrifugal dutch on the side facing away from the blower housing. Further alternative embodiments are also possible in this context, of course. One of the advantages of this one-piece embodiment is that fewer process steps are necessary during the assembly process of the tool. A further advantage is that good heat dissipation may occur with appropriate selection of the material.

The housing, in which the ventilator wheel is situated so it is rotatably mounted, expediently has an air inlet and an air outlet. The second air flow, which flows from the centrifugal separator and is loaded with dirt particles, reaches the air inlet and is guided through the air outlet of the housing. The ventilator wheel is situated in the blower housing in such a way that the air flow loaded with dirt particles does not reach behind the ventilator wheel, i.e., the chamber in which the drive unit having clutch, crankshaft, etc., is located remains free of dirt particles.

In order that no dust of the second air flow reaches the chamber of the drive unit, the ventilator wheel may have a seal on its outer diameter, for example. This seal reliably seals off the chamber of the lower housing. In an especially preferred embodiment of the intake device, the seal may be a radial shaft seal ring, for example.

In a conceivable alternative embodiment of the present invention, the air outlet of the blower housing discharges into the surroundings. I.e., the dirt or dust which is drawn off, after it has been sucked through the ventilator wheel and conducted through the inlet and outlet openings of the blower housing, is blown back into the open air.

To obtain good intake and/or ejection behavior of the air charged with dirt particles, the air inlet of the blower housing is designed as implemented essentially radially to the axis of rotation of the ventilator wheel and the air outlet is implemented as directed tangentially to the cited axis of rotation. A good cooling effect of the centrifugal dutch is simultaneously achieved by a design of the air inlet and the air outlet of this type.

In an alternative embodiment of the intake device, it may be advantageous for the air outlet of the blower housing to lead into the exhaust of the tool. The air flow loaded with dirt partides is conducted to the exhaust, for example, via a channel, in order to cool the exhaust gas flow and/or the muffler situated in the exhaust effectively therein. The cool second air flow loaded with dust particles flows along the outer skin of the muffler positioned in the exhaust, by which an effective cooling effect is achievable. The engine exhaust gas mixes with the second air flow in the exhaust chamber, which leave the tool jointly into the surroundings at the exhaust outlet.

BRIEF DESCRIPTION OF THE DRAWINGS

Further advantages, features, and details of the present invention result from the following description, in which an exemplary embodiment of the present invention is described in detail with reference to the drawing. The features cited in the claims and in the description may each be essential to the present invention individually or in any arbitrary combination. In schematic illustrations:

DETAILED DESCRIPTION OF THE PREFERRED EMBODIMENTS

Figure 1:
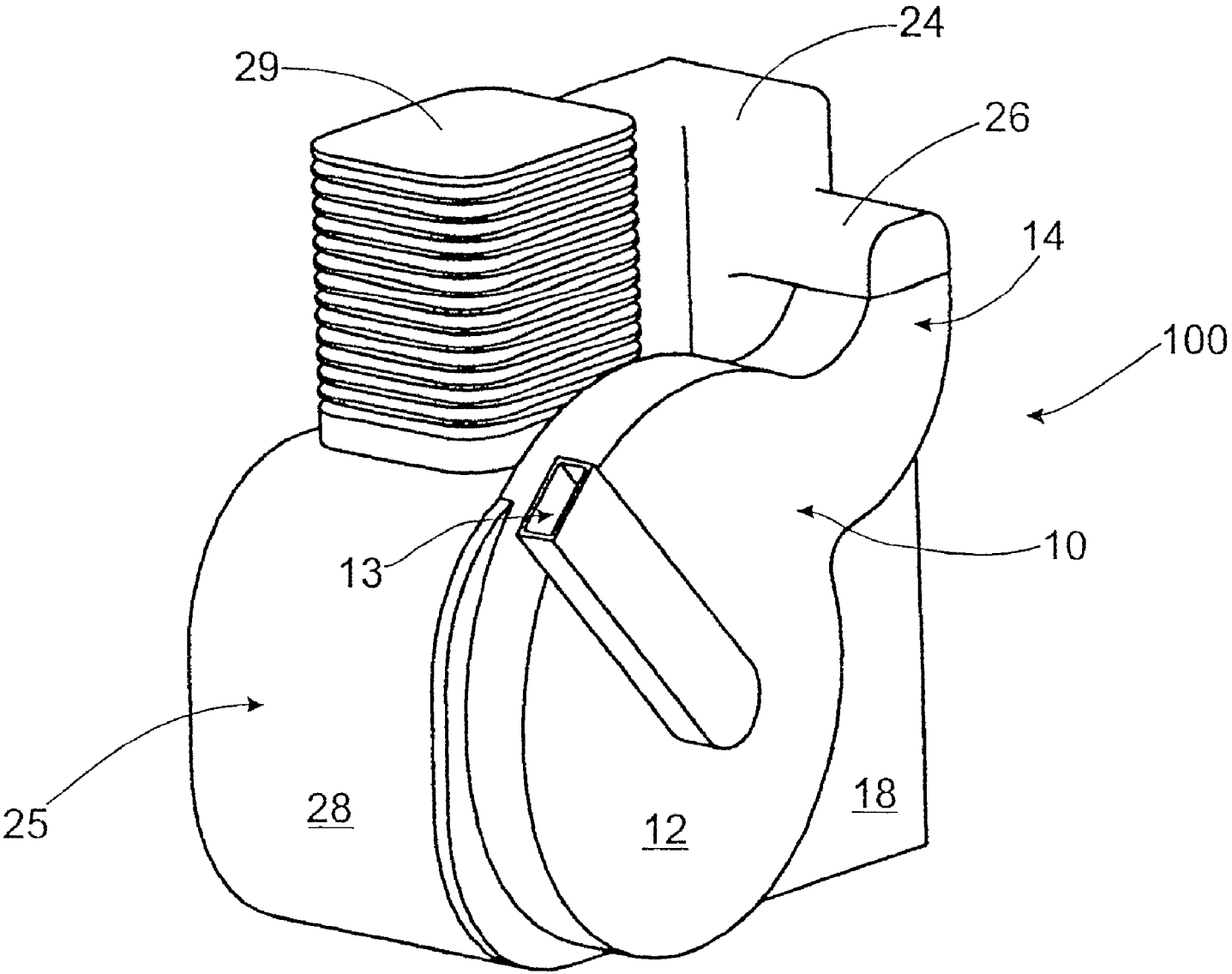
FIG. 1 shows a perspective view of an intake device according to the present invention for a handheld tool.
Figure 3:
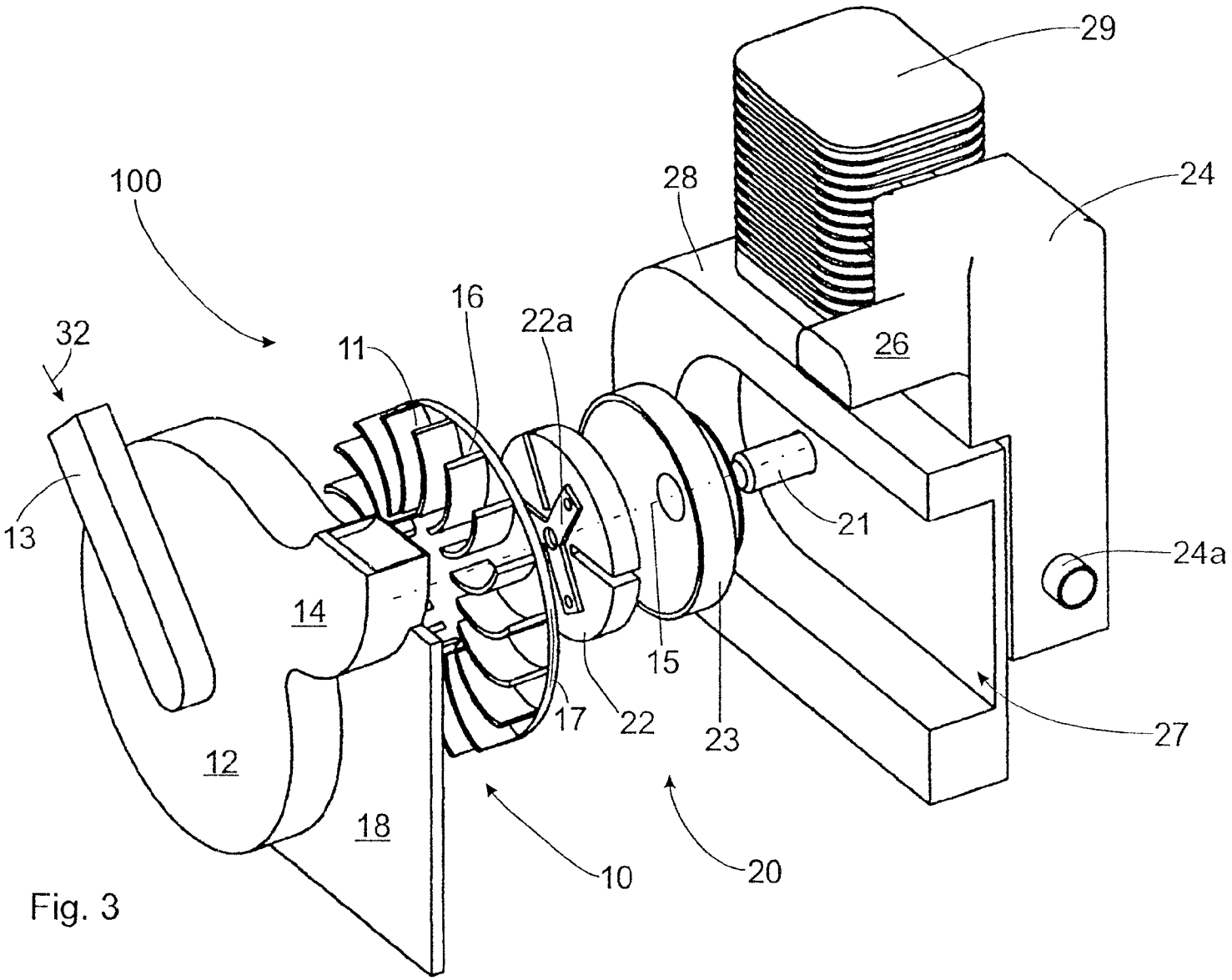
FIG. 3 shows an exploded illustration of the intake device from FIG. 1.
Figure 4:
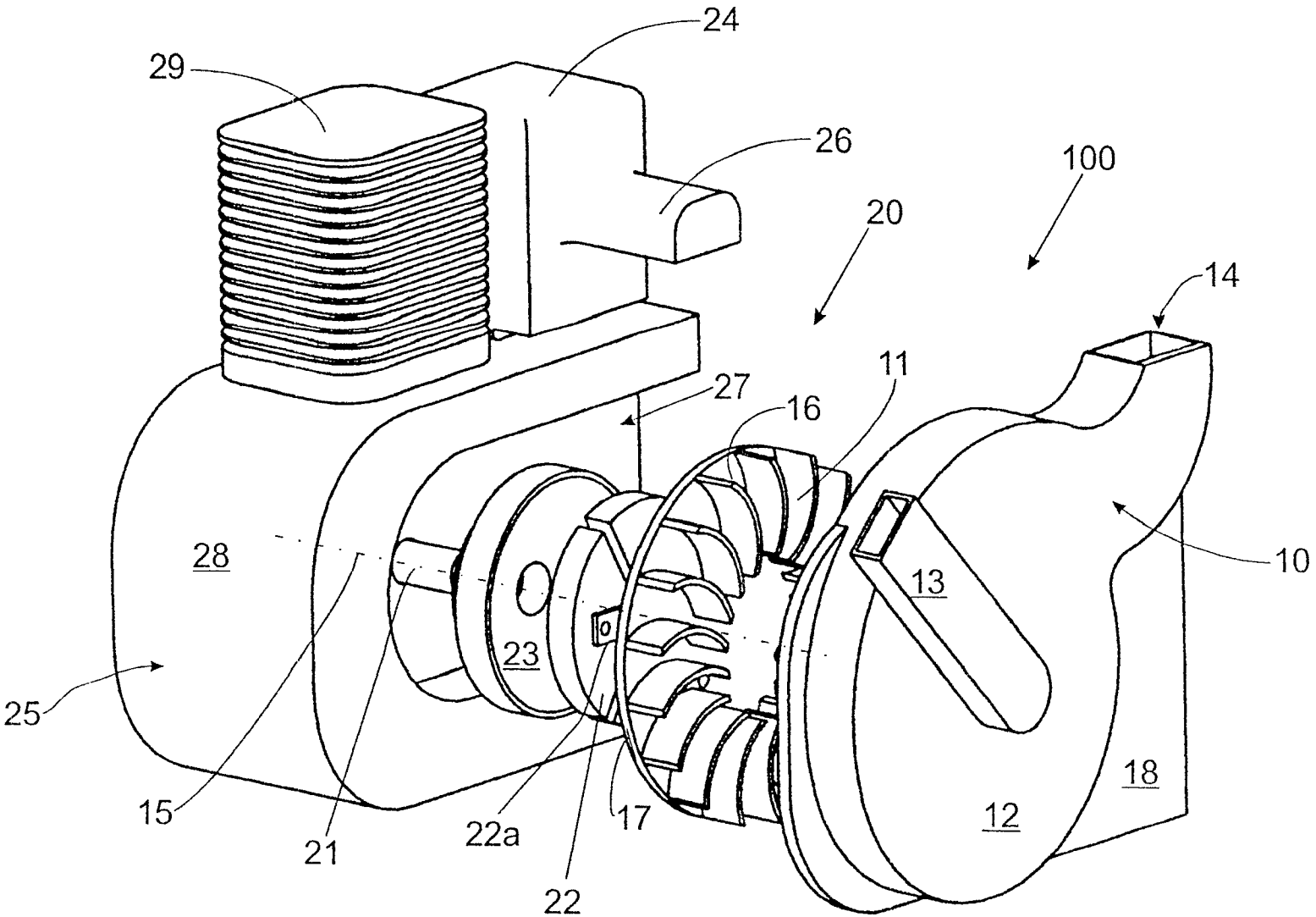
FIG. 4 shows an exploded illustration of a further illustration of the intake device.

FIG. 1 illustrates an intake device 100 of the tool. The tool, which is a cutting-off grinding tool in the exemplary embodiment shown, has an internal combustion engine 25, which is situated inside the engine housing 28. The cylinder 29 of the internal combustion engine 25 is visible from the outside. Furthermore, a blower 10 having a blower housing 12 is attached to the engine housing 28, which is illustrated in FIGS. 3 and 4. The housing 12 is implemented having an air inlet 13 and an air outlet 14. The air inlet 13 is implemented in the form of a channel. In the exemplary embodiment shown, the channel has a rectangular cross-section.

FIG. 3 and FIG. 4 indicate that the blower 10 has a ventilator wheel 11, which is received in the blower housing 12 and is situated so it is mounted rotatably around an axis of rotation 15. The air inlet channel 13 runs essentially radially to the axis 15. In contrast to the air inlet 13, the air outlet 14 is implemented as directed essentially tangentially to the axis 15.

The intake device 100 illustrated in FIGS. 1-4 is implemented having an air cleaner, which sucks in combustion air from the surroundings. It is problematic that in operation of tools of this type, particularly with cutting-off grinding tools, dirt such as dust or the like is produced by the tool. The dirt may be formed from organic or inorganic particles. The combustion air sucked in by the internal combustion engine 25 must be cleaned before entry into the combustion chamber (not shown) of the internal combustion engine 25 to avoid wear. For this purpose, the intake device 100 has a centrifugal separator 30, shown purely schematically in FIG. 2, which sucks in ambient air 33 loaded with dirt particles from the outside and separates the combustion air 33 into at least one first air flow 31, which is freed from dirt particles as much as possible, and a second air flow 32, which is loaded with dirt particles. The first air flow 31 is subsequently guided into the combustion chamber of the internal combustion engine 25. An air filter is preferably located between the internal combustion engine 25 and the centrifugal separator 30, which additionally deans the air flow 31, which is freed as much as possible from dirt particles, which is not shown explicitly. The air 32 loaded with dirt particles is conducted into the air inlet 13, the ventilator wheel 11 causing the required partial vacuum to arise using its guide blades.

As may be seen clearly from FIG. 3 and FIG. 4, the tool is equipped with a drive unit 20, which is operationally linked to the engine 25 situated inside the engine housing 28. A crankshaft 21 extends from the engine housing 28 in the direction of the blower 10. The crankshaft 21 is connected to a centrifugal clutch 22, which is in turn attached directly to the ventilator wheel 11. A clutch drum 23, in which the centrifugal clutch 22 is situated, is located between the crankshaft 21 and the centrifugal clutch 22. Furthermore, the centrifugal clutch 22 has a clutch receptacle 22*a* facing toward the ventilator wheel 11. The clutch receptacle 22*a* is used to attach the ventilator wheel 11. The ventilator wheel 11 has a circular cover 16, which is connectable so it is attachable to the clutch receptacle 22*a*. Formfitting and/or frictionally connected and/or materially bonded attachment alternatives are conceivable for this purpose. A seal ring 17 is provided on the circumference of the ventilator wheel 11.

Furthermore, the engine housing 28 has a recess 27, which encloses the drive unit 20 having the crankshaft 21, the clutch drum 23, and the centrifugal clutch 22. A pulley may be situated on the circumference of the clutch drum 23, which is operationally linked to the attachment (not shown). Furthermore, the tool is equipped with an exhaust 24, which has an exhaust gas muffler (not shown) inside. The exhaust 24 is implemented having an inlet channel 26, which is connected to the air outlet 14 of the blower housing 12. Moreover, the exhaust 24 has an exhaust outlet 24*a*.

During the operation of the tool, the internal combustion engine 25 drives the crankshaft 21 at a corresponding speed. The centrifugal clutch 22 and the ventilator wheel 11 are accordingly brought into rotation around the axis of rotation 15 by the crankshaft 21. The ventilator wheel 11 generates a corresponding partial vacuum inside the blower housing 10, particularly with the aid of the blower blades, which sucks the second air flow 32 escaping from the centrifugal separator 30 in through the air intake 13. The air flow 32 loaded with dirt particles is conducted through the housing 12 and leaves it at the air outlet 14, the second air flow 32 being conducted directly via the inlet channel 26 into the exhaust 24. While the second air flow 32 flows through the housing 12 along the ventilator wheel 11, cooling of the centrifugal clutch 22, which may reach high temperatures during operation, is caused. The second air flow 32 mixes with the combustion gas which leaves the engine 25 and/or the combustion chamber of the engine 25 inside the exhaust 24 and reaches the surroundings through the exhaust outlet 24*a*. It has been shown that by guiding the second air flow 32 via a blower 10 into the exhaust chamber in this way, effective cooling of the exhaust gas coming out of the exhaust 24 may be achieved.

The drive 20 is implemented in such a way that the attachment is first driven at an appropriate speed of the engine 25. This is achieved by the centrifugal clutch 22 illustrated here, which first produces a frictional connection with the clutch drum 23 at a specific speed. Of course, alternative drive units are also usable in regard to the present invention.

Figure 2:
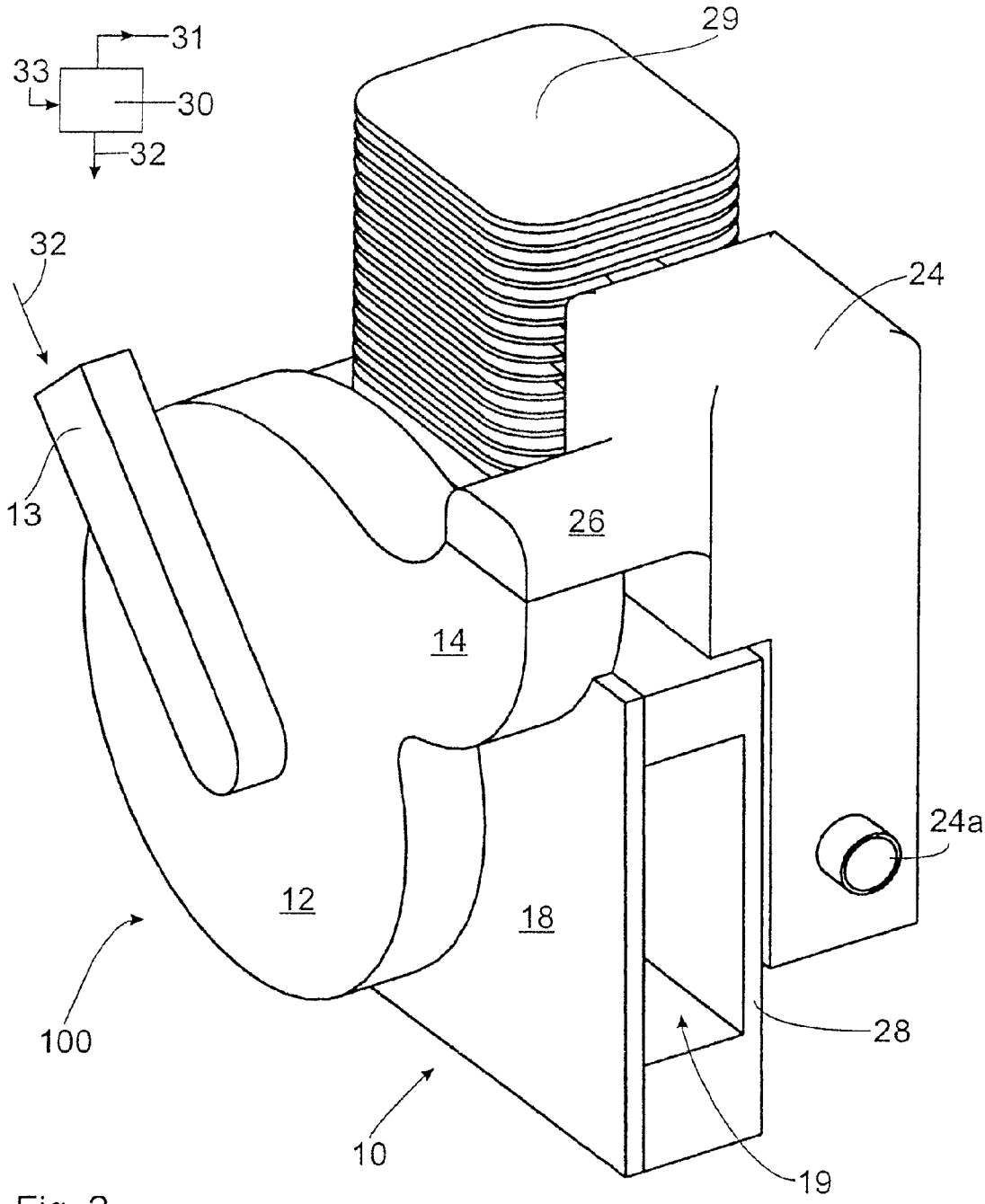
FIG. 2 shows the intake device from FIG. 1 in a further perspective view.

As shown in FIG. 2, the blower housing 12 has a cover 18, which are materially bonded to one another. The engine housing 28 having its recess 27 and the cover 18 form an opening 19, through which the pulley situated on the clutch drum 23 extends.

LIST OF REFERENCE NUMERALS

100 intake device
10 blower
11 ventilator wheel
12 housing
13 air inlet
14 air outlet
15 axis
16 cover
17 seal
18 cover
19 opening
20 drive unit
21 crankshaft
22 clutch
22*a* clutch receptacle
23 clutch drum
24 exhaust
24*a* exhaust outlet
25 engine
26 inlet channel
27 recess
28 engine housing
29 cylinder
30 centrifugal separator
31 first air flow
32 second air flow
33 ambient air, combustion air

The invention claimed is:

1. An intake device for a handheld tool having an internal combustion engine and a drive unit operably linked to the engine, said intake device comprising;

a centrifugal separator that separates combustion air for the engine into first and second air flows, said combustion air being loaded with dirt particles, wherein the first air flow has a lower dirt particle density than both the second air flow and the combustion air; and a blower situated on the drive unit and having a housing with an air inlet and an air outlet, said blower drawing in the second air flow through the air inlet for cooling of the drive unit, wherein the air outlet of the blower housing leads into an exhaust of the tool for the second air flow to cool exhaust gas coming out of the exhaust.

2. The intake device according to claim 1, characterized in that the drive unit comprises a crankshaft, which is drivable by the engine, and a clutch, on which the blower is directly situated.

3. The intake device according to claim 2, characterized in that the clutch is a centrifugal clutch, which is situated in a clutch drum, the clutch drum being drivable by the clutch at a corresponding speed of the crankshaft.

4. The intake device according to claim 2, characterized in that the blower includes a ventilator wheel received in the blower housing and situated so it is rotatably mounted around an axis.

5. The intake device according to claim 4 characterized in that the clutch and the ventilator wheel are in one piece and/or are materially bonded to one another.

6. The intake device according to claim 4, characterized in that the ventilator wheel comprises a metallic material.

7. The intake device according to claim 4, characterized in that the air inlet is directed essentially radially to the axis and the air outlet is implemented as directed essentially tangentially to the axis.

8. The intake device according to claim 4, characterized in that the ventilator wheel has a cover on the side facing toward the clutch.

9. The intake device according to claim 4, characterized in that the ventilator wheel has a seal on its external diameter.

10. The intake device according to claim 1, characterized in that the exhaust has an inlet channel into which the air outlet leads.

11. The intake device according to claim 1, characterized in that the drive unit is situated in a recess in an engine housing portion of the tool.

12. The intake device according to claim 1, characterized in that the blower housing is integrated with a cover that covers the drive unit.

13. A handheld tool comprising;

an internal combustion engine having an exhaust system;

a drive unit powered by the engine; and an intake device comprising: a centrifugal separator that separates source air into first and second air flows, said source air being loaded with dirt particles, wherein the first air flow has a lower dirt particle density than the second air flow and the source air, said first air flow being directed to the engine for combustion purposes; and a blower situated on the drive unit and having a housing with an air inlet and an air outlet, said blower drawing in the second air flow through the air inlet for cooling the drive unit, wherein the air outlet of the blower housing leads into the exhaust system of the tool for the second air flow to aid in cooling exhaust gas generated by the engine.

* * * * *